US007990393B2

(12) United States Patent
Higgins

(10) Patent No.: US 7,990,393 B2
(45) Date of Patent: Aug. 2, 2011

(54) SYSTEMS AND METHODS FOR IMPLEMENTING LOW COST GAMUT MAPPING ALGORITHMS

(75) Inventor: Michael Francis Higgins, Cazadero, CA (US)

(73) Assignee: Samsung Electronics Co., Ltd. (KR)

( * ) Notice: Subject to any disclaimer, the term of this patent is extended or adjusted under 35 U.S.C. 154(b) by 572 days.

(21) Appl. No.: 11/815,442

(22) PCT Filed: Apr. 4, 2006

(86) PCT No.: PCT/US2006/012766

§ 371 (c)(1),
(2), (4) Date: Aug. 2, 2007

(87) PCT Pub. No.: WO2006/108083

PCT Pub. Date: Oct. 12, 2006

(65) Prior Publication Data

US 2008/0150958 A1 Jun. 26, 2008

Related U.S. Application Data

(60) Provisional application No. 60/668,511, filed on Apr. 4, 2005.

(51) Int. Cl.
*G09G 5/02* (2006.01)

(52) U.S. Cl. ..... 345/604; 345/589; 345/590; 345/690; 382/167

(58) Field of Classification Search ..... None
See application file for complete search history.

(56) References Cited

U.S. PATENT DOCUMENTS

| | | | |
|---|---|---|---|
| 4,989,079 | A | 1/1991 | Ito |
| 5,450,216 | A | 9/1995 | Kasson |
| 5,694,186 | A | 12/1997 | Yanagawa et al. |
| 5,724,442 | A | 3/1998 | Ogatsu et al. |

(Continued)

FOREIGN PATENT DOCUMENTS

| | | | |
|---|---|---|---|
| CN | 1551707 | A | 12/2004 |

(Continued)

OTHER PUBLICATIONS

Brown Elliott, C., "Color Subpixel Rendering Projectors and Flat Panel Displays," SMPTE, Feb. 27-Mar. 1, 2003, Seattle, WA pp. 1-4.

(Continued)

*Primary Examiner* — Antonio A Caschera
(74) *Attorney, Agent, or Firm* — Innovation Counsel LLP

(57) ABSTRACT

Techniques for low cost gamma mapping convert three-primary input image data, such as RGB data, into a four primary color display color space, such as an RGBW color space, for rendering on the display by calculating a value for W image data based upon the RGB image input data; deriving an allowable value for W based upon a chromaticity specification of the display, and calculating output values for R, G and B image data based upon the allowable W value. A display system receiving input image data specified in three input primary colors includes modules for converting the input image data into image data specifying color values in four display primary colors. A first module determines a value of a first display primary color, and a second module determines the value of second, third and fourth display primary colors by computing a solution set to simultaneous equations based upon the value of the first display primary color.

9 Claims, 6 Drawing Sheets

U.S. PATENT DOCUMENTS

| | | | | |
|---|---|---|---|---|
| 5,937,089 | A | 8/1999 | Kobayashi | |
| 5,963,263 | A | 10/1999 | Shyu | |
| 5,973,800 | A | 10/1999 | Usui et al. | |
| 5,987,165 | A | 11/1999 | Matsuzaki et al. | |
| 6,023,527 | A | 2/2000 | Narahara | |
| 6,216,130 | B1 | 4/2001 | Hougaard et al. | |
| 6,268,930 | B1 | 7/2001 | Ohta et al. | |
| 6,873,339 | B2 | 3/2005 | Ohsawa et al. | |
| 6,885,380 | B1 | 4/2005 | Primerano et al. | |
| 6,897,876 | B2 | 5/2005 | Murdoch et al. | |
| 6,980,219 | B2 | 12/2005 | Higgins | |
| 6,992,683 | B2 | 1/2006 | Shin et al. | |
| 7,015,927 | B2 | 3/2006 | Matsushiro et al. | |
| 7,164,429 | B1 * | 1/2007 | Moroney | 345/603 |
| 7,176,935 | B2 | 2/2007 | Higgins | |
| 7,277,075 | B1 * | 10/2007 | Hirano et al. | 345/89 |
| 7,586,497 | B2 * | 9/2009 | Boroson et al. | 345/590 |
| 7,839,418 | B2 * | 11/2010 | Kwon | 345/604 |
| 2003/0011613 | A1 | 1/2003 | Booth, Jr. | |
| 2003/0117457 | A1 | 6/2003 | Qiao | |
| 2003/0179212 | A1 | 9/2003 | Matsushiro et al. | |
| 2004/0066387 | A1 | 4/2004 | Kumar et al. | |
| 2004/0111435 | A1 | 6/2004 | Herbert et al. | |
| 2005/0083341 | A1 | 4/2005 | Higgins et al. | |
| 2005/0083344 | A1 | 4/2005 | Higgins | |
| 2005/0083345 | A1 | 4/2005 | Higgins | |
| 2005/0083352 | A1 | 4/2005 | Higgins | |
| 2005/0099426 | A1 | 5/2005 | Primerano et al. | |
| 2005/0184998 | A1 | 8/2005 | Yang et al. | |
| 2005/0225562 | A1 | 10/2005 | Higgins et al. | |
| 2005/0264580 | A1 | 12/2005 | Higgins | |
| 2006/0244686 | A1 | 11/2006 | Higgins et al. | |

FOREIGN PATENT DOCUMENTS

| | | | |
|---|---|---|---|
| GB | 2 282 928 | A | 4/1995 |
| TW | 200509058 | | 3/2005 |

OTHER PUBLICATIONS

Brown Elliott, C, "Co-Optimization of Color AMLCD Subpixel Architecture and Rendering Algorithms," SID 2002 Proceedings Paper, May 30, 2002 pp. 172-175.

Brown Elliott, C, "Development of the PenTile Matrix™ Color AMLCD Subpixel Architecture and Rendering Algorithms", SID 2003, Journal Article.

Brown Elliott, C, "New Pixel Layout for PenTile Matrix™ Architecture", IDMC 2002, pp. 115-117.

Brown Elliott, C, "Reducing Pixel Count Without Reducing Image Quality", Information Display Dec. 1999, vol. 1, pp. 22-25.

Credelle, Thomas, "P-00: MTF of High-Resolution PenTile Matrix Displays", Eurodisplay 02 Digest, 2002 pp. 1-4.

Morovic, J., Gamut Mapping, in Digital Color Imaging Handbook, ed. G. Sharma, Boca Raton, FL: CRC Press, Dec. 2002, Chapter 10, pp. 635-682.

PCT International Search Report dated May 21, 2007 for PCT/US04/33709 (U.S. Appl. No. 10/691,396).

PCT International Search Report dated Apr. 26, 2005 for PCT/US04/33743 (US Patent No. 7,176,935).

PCT International Search Report dated Jun. 21, 2006 for PCT/US05/010021 (U.S. Appl. No. 10/821,306).

PCT International Search Report dated Oct. 23, 2006 for PCT/US06/012766 (U.S. Appl. No. 60/668,511).

USPTO, Notice of Allowance, dated Mar. 21, 2005 in US Patent No. 6,980,219 (U.S. Appl. No. 10/691,200).

USPTO, Non-Final Office Action dated Jul. 20, 2007 in US Patent Publication No. 2005/0264580 (U.S. Appl. No. 11/196,631).

USPTO, Non-Final Office Action dated Jul. 27, 2006 in US Patent Publication No. 2005/0083352 (U.S. Appl. No. 10/691,396).

Clairvoyante, Inc. Response to Non-Final Office Action, dated Dec. 20, 2006 in US Patent Publication No. 2005/0083352 (U.S. Appl. No. 10/691,396).

USPTO, Non-Final Office Action dated Mar. 6, 2007 in US Patent Publication No. 2005/0083352 (U.S. Appl. No. 10/691,396).

Clairvoyante, Inc. Response to Non-Final Office Action, dated Jul. 6, 2007 in US Patent Publication No. 2005/0083352 (U.S. Appl. No. 10/691,396).

USPTO, Non-Final Office Action dated Jun. 13, 2005 in US Patent No. 7,176,935 (U.S. Appl. No. 10/690,716).

Clairvoyante, Inc. Response to Non-Final Office Action, dated Dec. 13, 2005 in US Patent No. 7,176,935 (U.S. Appl. No. 10/690,716).

Clairvoyante, Inc., Supplemental Amendment dated Aug. 23, 2006 in US Patent No. 7,176,935 (U.S. Appl. No. 10/690,716).

USPTO, Interview Summary, dated Aug. 25, 2006 in US Patent No. 7,176,935 (U.S. Appl. No. 10/690,716).

USPTO, Interview Summary, dated Aug. 29, 2006 in US Patent No. 7,176,935 (U.S. Appl. No. 10/690,716).

* cited by examiner

SYSTEMS AND METHODS FOR IMPLEMENTING LOW COST GAMUT MAPPING ALGORITHMS

CROSS REFERENCE TO RELATED APPLICATIONS

This application is the U.S. National Stage under 35 U.S. 371 of International Application No. PCT/US06/12766, filed on 5 Apr. 2006, which claims the benefit of U.S. Provisional Application 60/668,511 entitled SYSTEMS AND METHODS FOR IMPLEMENTING LOW-COST GAMUT MAPPING ALGORITHMS, filed on Apr. 4, 2005.

The following co-owned applications are related to the present application and are herein incorporated by reference: (1) U.S. Patent Application Ser. No. 60/668,510 entitled "EFFICIENT MEMORY STRUCTURE FOR DISPLAY SYSTEM WITH NOVEL SUBPIXEL STRUCTURES"; (2) U.S. Patent Application Ser. No. 60/668,512 entitled "SYSTEMS AND METHODS FOR IMPLEMENTING IMPROVED GAMUT MAPPING ALGORITHMS" and (3) U.S. Patent Application Ser. No. 60/668,578 entitled "PRE-SUBPIXEL RENDERED IMAGE PROCESSING IN DISPLAY SYSTEMS."

TECHNICAL FIELD

The present application relates to various embodiments of display systems and methods for implementing low-cost gamut mapping algorithms therein.

BACKGROUND

In commonly owned United States Patents and Patent Applications including: (1) U.S. Pat. No. 6,903,754 ("the '754 patent") entitled "ARRANGEMENT OF COLOR PIXELS FOR FULL COLOR IMAGING DEVICES WITH SIMPLIFIED ADDRESSING;" (2) United States Patent Publication No. 2003/0128225 ("the '225 application") having application Ser. No. 10/278,353 and entitled "IMPROVEMENTS TO COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE," filed Oct. 22, 2002; (3) United States Patent Publication No. 2003/0128179 ("the '179 application") having application Ser. No. 10/278,352 and entitled "IMPROVEMENTS TO COLOR FLAT PANEL DISPLAY SUB-PIXEL ARRANGEMENTS AND LAYOUTS FOR SUB-PIXEL RENDERING WITH SPLIT BLUE SUB-PIXELS," filed Oct. 22, 2002; (4) United States Patent Publication No. 2004/0051724 ("the '724 application") having application Ser. No. 10/243,094 and entitled "IMPROVED FOUR COLOR ARRANGEMENTS AND EMITTERS FOR SUB-PIXEL RENDERING," filed Sep. 13, 2002; (5) United States Patent Publication No. 2003/0117423 ("the '423 application") having application Ser. No. 10/278,328 and entitled "IMPROVEMENTS TO COLOR FLAT PANEL DISPLAY SUB-PIXEL ARRANGEMENTS AND LAYOUTS WITH REDUCED BLUE LUMINANCE WELL VISIBILITY," filed Oct. 22, 2002; (6) United States Patent Publication No. 2003/0090581 ("the '581 application") having application Ser. No. 10/278,393 and entitled "COLOR DISPLAY HAVING HORIZONTAL SUB-PIXEL ARRANGEMENTS AND LAYOUTS," filed Oct. 22, 2002; and (7) United States Patent Publication No. 2004/0080479 ("the '479 application") having application Ser. No. 10/347,001 and entitled "IMPROVED SUB-PIXEL ARRANGEMENTS FOR STRIPED DISPLAYS AND METHODS AND SYSTEMS FOR SUB-PIXEL RENDERING SAME," filed Jan. 16, 2003, novel sub-pixel arrangements are disclosed for improving the cost/performance curves for image display devices. Each of the aforementioned '225, '179, '724, '423, '581, and '479 published applications and U.S. Pat. No. 6,903,754 are hereby incorporated by reference herein in its entirety.

For certain subpixel repeating groups having an even number of subpixels in a horizontal direction, systems and techniques to affect improvements, e.g. proper dot inversion schemes and other improvements, are disclosed in the following commonly owned United States patent documents: (1) United States Patent Publication No. 2004/0246280 ("the '280 application") having application Ser. No. 10/456,839 and entitled "IMAGE DEGRADATION CORRECTION IN NOVEL LIQUID CRYSTAL DISPLAYS"; (2) United States Patent Publication No. 2004/0246213 ("the '213 application") (U.S. patent application Ser. No. 10/455,925) entitled "DISPLAY PANEL HAVING CROSSOVER CONNECTIONS EFFECTING DOT INVERSION"; (3) United States Patent Publication No. 2004/0246381 ("the '381 application") having application Ser. No. 10/455,931 and entitled "SYSTEM AND METHOD OF PERFORMING DOT INVERSION WITH STANDARD DRIVERS AND BACKPLANE ON NOVEL DISPLAY PANEL LAYOUTS"; (4) United States Patent Publication No. 2004/0246278 ("the '278 application") having application Ser. No. 10/455,927 and entitled "SYSTEM AND METHOD FOR COMPENSATING FOR VISUAL EFFECTS UPON PANELS HAVING FIXED PATTERN NOISE WITH REDUCED QUANTIZATION ERROR"; (5) United States Patent Publication No. 2004/0246279 ("the '279 application") having application Ser. No. 10/456,806 entitled "DOT INVERSION ON NOVEL DISPLAY PANEL LAYOUTS WITH EXTRA DRIVERS"; (6) United States Patent Publication No. 2004/0246404 ("the '404 application") having application Ser. No. 10/456,838 and entitled "LIQUID CRYSTAL DISPLAY BACKPLANE LAYOUTS AND ADDRESSING FOR NON-STANDARD SUBPIXEL ARRANGEMENTS"; (7) United States Patent Publication No. 2005/0083277 ("the '277 application") having application Ser. No. 10/696,236 entitled "IMAGE DEGRADATION CORRECTION IN NOVEL LIQUID CRYSTAL DISPLAYS WITH SPLIT BLUE SUBPIXELS", filed Oct. 28, 2003; and (8) United States Patent Publication No. 2005/0212741 ("the '741 application") having application Ser. No. 10/807,604 and entitled "IMPROVED TRANSISTOR BACKPLANES FOR LIQUID CRYSTAL DISPLAYS COMPRISING DIFFERENT SIZED SUBPIXELS", filed Mar. 23, 2004. Each of the aforementioned '280, '213, '381, '278, '404, '277 and '741 published applications are hereby incorporated by reference herein in its entirety.

These improvements are particularly pronounced when coupled with sub-pixel rendering (SPR) systems and methods further disclosed in the above-referenced U.S. Patent documents and in commonly owned United States Patents and Patent Applications: (1) United States Patent Publication No. 2003/0034992 ("the '992 application") having application Ser. No. 10/051,612 and entitled "CONVERSION OF A SUB-PIXEL FORMAT DATA TO ANOTHER SUB-PIXEL DATA FORMAT," filed Jan. 16, 2002; (2) United States Patent Publication No. 2003/0103058 ("the '058 application") having application Ser. No. 10/150,355 entitled "METHODS AND SYSTEMS FOR SUB-PIXEL RENDERING WITH GAMMA ADJUSTMENT," filed May 17, 2002; (3) United States Patent Publication No. 2003/0085906

("the '906 application") having application Ser. No. 10/215,843 and entitled "METHODS AND SYSTEMS FOR SUB-PIXEL RENDERING WITH ADAPTIVE FILTERING," filed Aug. 8, 2002; (4) United States Publication No. 2004/0196302 ("the '302 application") having application Ser. No. 10/379,767 and entitled "SYSTEMS AND METHODS FOR TEMPORAL SUB-PIXEL RENDERING OF IMAGE DATA" filed Mar. 4, 2003; (5) United States Patent Publication No. 2004/0174380 ("the '380 application") having application Ser. No. 10/379,765 and entitled "SYSTEMS AND METHODS FOR MOTION ADAPTIVE FILTERING," filed Mar. 4, 2003; (6) U.S. Pat. No. 6,917,368 ("the '368 patent") entitled "SUB-PIXEL RENDERING SYSTEM AND METHOD FOR IMPROVED DISPLAY VIEWING ANGLES"; and (7) United States Patent Publication No. 2004/0196297 ("the '297 application") having application Ser. No. 10/409,413 and entitled "IMAGE DATA SET WITH EMBEDDED PRE-SUBPIXEL RENDERED IMAGE" filed Apr. 7, 2003. Each of the aforementioned '992, '058, '906, '302, 380 and '297 applications and the '368 patent are hereby incorporated by reference herein in its entirety.

Improvements in gamut conversion and mapping are disclosed in commonly owned United States Patents and co-pending United States Patent Applications: (1) U.S. Pat. No. 6,980,219 ("the '219 patent") entitled "HUE ANGLE CALCULATION SYSTEM AND METHODS"; (2) United States Patent Publication No. 2005/0083341 ("the '341 application") having application Ser. No. 10/691,377 and entitled "METHOD AND APPARATUS FOR CONVERTING FROM SOURCE COLOR SPACE TO RGBW TARGET COLOR SPACE", filed Oct. 21, 2003; (3) United States Patent Publication No. 2005/0083352 ("the '352 application") having application Ser. No. 10/691,396 and entitled "METHOD AND APPARATUS FOR CONVERTING FROM A SOURCE COLOR SPACE TO A TARGET COLOR SPACE", filed Oct. 21, 2003; and (4) United States Patent Publication No. 2005/0083344 ("the '344 application") having application Ser. No. 10/690,716 and entitled "GAMUT CONVERSION SYSTEM AND METHODS" filed Oct. 21, 2003. Each of the aforementioned '341, '352 and '344 applications and the '219 patent is hereby incorporated by reference herein in its entirety.

Additional advantages have been described in (1) United States Patent Publication No. 2005/0099540 ("the '540 application") having application Ser. No. 10/696,235 and entitled "DISPLAY SYSTEM HAVING IMPROVED MULTIPLE MODES FOR DISPLAYING IMAGE DATA FROM MULTIPLE INPUT SOURCE FORMATS", filed Oct. 28, 2003; and in (2) United States Patent Publication No. 2005/0088385 ("the '385 application") having application Ser. No. 10/696,026 and entitled "SYSTEM AND METHOD FOR PERFORMING IMAGE RECONSTRUCTION AND SUB-PIXEL RENDERING TO EFFECT SCALING FOR MULTI-MODE DISPLAY" filed Oct. 28, 2003, each of which is hereby incorporated herein by reference in its entirety.

Additionally, each of these co-owned and co-pending applications is herein incorporated by reference in its entirety: (1) United States Patent Publication No. 2005/0225548 ("the '548 application") having application Ser. No. 10/821,387 and entitled "SYSTEM AND METHOD FOR IMPROVING SUB-PIXEL RENDERING OF IMAGE DATA IN NON-STRIPED DISPLAY SYSTEMS"; (2) United States Patent Publication No. 2005/0225561 ("the '561 application") having application Ser. No. 10/821,386 and entitled "SYSTEMS AND METHODS FOR SELECTING A WHITE POINT FOR IMAGE DISPLAYS"; (3) United States Patent Publication No. 2005/0225574 ("the '574 application") and United States Patent Publication No. 2005/0225575 ("the '575 application") having application Ser. No. 10/821,353 and Ser. No. 10/961,506 respectively, and both entitled "NOVEL SUBPIXEL LAYOUTS AND ARRANGEMENTS FOR HIGH BRIGHTNESS DISPLAYS"; (4) United States Patent Publication No. 2005/0225562 ("the '562 application") having application Ser. No. 10/821,306 and entitled "SYSTEMS AND METHODS FOR IMPROVED GAMUT MAPPING FROM ONE IMAGE DATA SET TO ANOTHER"; (5) United States Patent Publication No. 2005/0225563 ("the '563 application") having application Ser. No. 10/821,388 and entitled "IMPROVED SUBPIXEL RENDERING FILTERS FOR HIGH BRIGHTNESS SUBPIXEL LAYOUTS"; and (6) United States Patent Publication No. 2005/0276502 ("the '502 application") having application Ser. No. 10/866,447 and entitled "INCREASING GAMMA ACCURACY IN QUANTIZED DISPLAY SYSTEMS."

DISCLOSURE OF THE INVENTION

A display system that receives input image data specified in three primary colors converts the input image data into an image data set of four primary colors. The display system comprises a module for determining a color value of a first primary color in the set of four primary colors, and a module for determining the value of the remaining three primary colors using the value of the first primary color. The remaining primary color values are determined by computing a solution to simultaneous equations based upon the color value of the first primary color.

A method for converting RGB input image data into an RGBW image data set for rendering on a display includes calculating a value for W image data based upon the RGB input image data, deriving an allowable value for W based upon a chromaticity specification for the display; and calculating output values for R, G and B input image data based upon the allowable W value.

BRIEF DESCRIPTION OF THE DRAWINGS

The accompanying drawings, which are incorporated in, and constitute a part of this specification illustrate exemplary implementations and embodiments of the invention and, together with the description, serve to explain principles of the invention.

DETAILED DESCRIPTION

Figure 1:
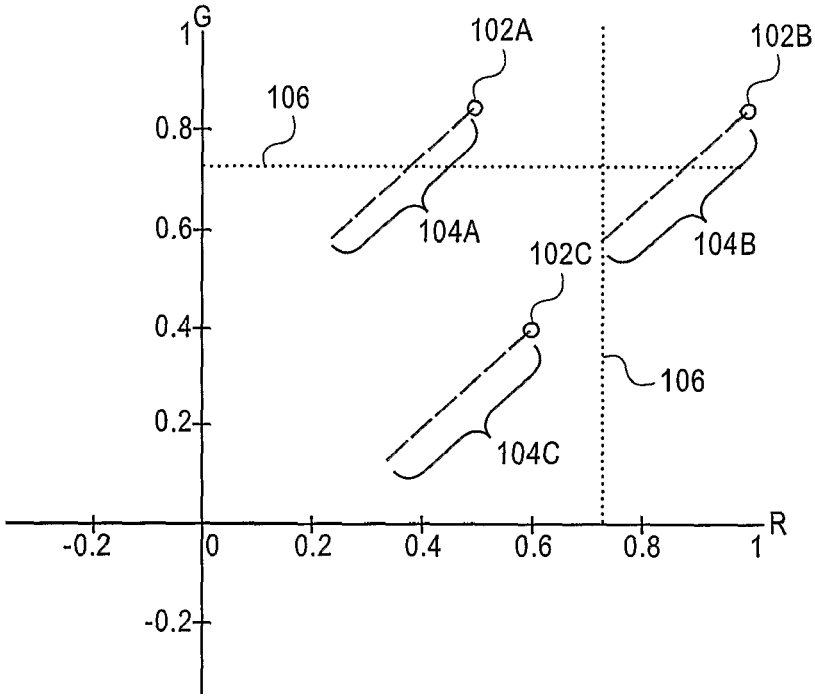
FIG. 1 shows the range that a white (W) primary value in an RGBW system can or cannot take in three different cases.

Systems and methods for implementing gamut mapping conversions (referred to herein as "GMA") from one color space to another (e.g. from RGB to RGBW) are known in the art. For example, the '562 application, incorporated here by reference, describes several such implementation methodologies. It is desirable to implement improved GMAs that either extend the color mapping or reduce display implementation costs, or both. Several embodiments of providing GMA will now be given. Some of these embodiments involve more computation, while others comprise calculations that may be easier and less costly to implement but may also provide acceptable results to the user.

As described in several of the GMA related applications incorporated above, a first step in performing RGB-to-RGBW GMA might be to find a 4×3 matrix that can convert from RGBW to CIE XYZ, based on colorimeter readings of the display primaries. Matrix 1 below is merely one example. Matrix 1 can be combined with the inverse of a standard matrix that converts CIE XYZ to RGB (see Matrix 2 below) resulting in a combined matrix that maps directly from RGBW to RGB, shown as Matrix 3 below.

| | | | | | | |
|---|---|---|---|---|---|---|
| 0.243954 | 0.247249 | 0.059607 | 0.369228 | 0.412391 | 0.357584 | 0.180481 |
| 0.129897 | 0.448725 | 0.036549 | 0.384829 | 0.212639 | 0.715169 | 0.072192 |
| 0.009665 | 0.079830 | 0.334841 | 0.455337 | 0.019331 | 0.119195 | 0.950532 |

Matrix 1, convert RGBW to CIE XYZ — Matrix 2, convert RGB to CIE XYZ

Matrix 1 was generated from measured data on a small LCD display. The measured primaries were not quite identical to the sRGB/NTSC standard primaries. The measured white point was somewhat yellowish, and distinguishable from the D65 standard. It should be appreciated and understood that, with each new model of display, the measurements could be taken to develop a new Matrix 1. Since similar displays with similar characteristics are likely to behave similarly, it may not be necessary to make such measurements for each new display.

Matrix 1, or conversion matrices derived from it, and in combination with the standard CIE XYZ to RGB matrix (e.g. Matrix 2), can be used to do color correction for the display while converting RGB to RGBW. The combination of Matrix 1 and the inverse of Matrix 2 results in a conversion matrix, Matrix 3, that converts RGBW to RGB. The values of Matrix 3 as derived from Matrices 1 and 2 above, are shown below.

| | | | |
|---|---|---|---|
| 0.586129 | 0.07166 | −0.029961 | 0.377991 |
| 0.007633 | 0.605467 | 0.024705 | 0.382977 |
| −0.00271 | 0.006603 | 0.349779 | 0.423322 |

Matrix 3, convert RGBW to RGB (=Inverse(Matrix 2) * Matrix 1)

Matrix 2 above converts display colors to source colors which is very useful for testing but it may be desired to have the inverse formula for converting source RGB colors (or other input sources such as YCbCr) to RGBW. When this matrix is used in an equation for RGB given $R_W G_W B_W W$, the equation looks like it cannot be inverted:

$$\begin{pmatrix} R \\ G \\ B \end{pmatrix} = \begin{pmatrix} 0.586129 & 0.07166 & -0.029961 & 0.377991 \\ 0.007633 & 0.605467 & 0.024705 & 0.382977 \\ -0.00271 & 0.006603 & 0.349779 & 0.423322 \end{pmatrix} \cdot \begin{pmatrix} R_W \\ G_W \\ B_W \\ W \end{pmatrix} \quad \text{Equation 1}$$

It should be appreciated that Matrix 3 may be derived in any number of ways different from shown above. For example, Matrix 1 may be derived either by measurement or by calculation or modeling of the display. Once Matrix 3 is derived, however, one way to derive a way to make (or approximate) an invertible process or system is to make a simplifying assumption: Because there are common primary colors (e.g., red, green and blue) in both systems, it may be possible to choose some arbitrary value for W and then solve the above equations for the $R_W$ $G_W$ and $B_W$ values. In one embodiment, W is defined as a constant instead of a variable; this reduces the number of variables from 4 to 3, making this a system of three equations and three unknowns. Subtracting the W terms from both sides makes this an equation that can be solved with matrix algebra.

$$\begin{pmatrix} R \\ G \\ B \end{pmatrix} - \begin{pmatrix} 0.377991 \\ 0.382977 \\ 0.423322 \end{pmatrix} \cdot W = \begin{pmatrix} 0.586129 & 0.07166 & -0.029961 \\ 0.007633 & 0.605467 & 0.024705 \\ -0.00271 & 0.006603 & 0.349779 \end{pmatrix} \cdot \begin{pmatrix} R_W \\ G_W \\ B_W \end{pmatrix} \quad \text{Equation 2}$$

After simplification the result is a set of three equations for $R_W$ $G_W$ and $B_W$:

$$\begin{pmatrix} 1.709510R - 0.636110W - 0.204083G + 0.160845B \\ -0.022109R - 0.575372W + 1.65553G - 0.118824B \\ 0.013662R - 1.204322W - 0.032834G + 2.862437B \end{pmatrix} = \begin{pmatrix} R_W \\ G_W \\ B_W \end{pmatrix} \quad \text{Equation 3}$$

Given Equation 3 and a source color in RGB space, it may then be possible to assign an arbitrary W value and then calculate the $R_W G_w B_w$ values that will produce a desired or suitable color. For some values of W, these $R_w G_w B_w$ values will be out of range, and this indicates that the desired color may not be "reached" with those values of W. It may be desirable to know the range on W given the desired RGB color. For example, if it is known that the range on Rw, Gw and Bw is between 0 and 1, then it is possible to calculate the minimum and maximum possible values of W by writing the previous equation as an inequality:

$$0 \leq \begin{pmatrix} 1.709510R - 0.636110W - 0.204083G + 0.160845B \\ -0.022109R - 0.575372W + 1.65553G - 0.118824B \\ 0.013662R - 1.204322W - 0.032834G + 2.862437B \end{pmatrix} \leq 1 \quad \text{Equation 4}$$

When W is solved for in Equation 4 above, a possible result may be:

$$\begin{pmatrix} \frac{1.709510R - 0.204083G + 0.160845B}{0.636110} \\ \frac{-0.022109R + 1.65553G - 0.118824B}{0.575372} \\ \frac{0.013662R - 0.032834G + 2.862437B}{1.204322} \end{pmatrix} \geq W \geq \begin{pmatrix} \frac{1.709510R - 0.204083G + 0.160845B - 1}{0.636110} \\ \frac{-0.022109R + 1.65553G - 0.118824B - 1}{0.575372} \\ \frac{0.013662R - 0.032834G + 2.862437B - 1}{1.204322} \end{pmatrix} \quad \text{Equation 5}$$

It may also be desirable to have W be smaller than the minimum of the three values calculated on the left side and larger than the maximum of the three calculated values on the right. Within these limits, there are many ways to "arbitrarily" choose a value for W. A minimum possible or maximum possible value may be calculated from Equation 5. Also, W could be set to the luminosity of the desired color and then clamped to the range from Equation 5. There may also be a minimum or a maximum W value different from the 0 to 1 range. As a further embodiment, the average of the minimum and maximum possible values could be used. Other embodiments may include other linear combinations of the range (besides the average) as possibly suitable choices. Once a value for W has been chosen (in whatever way possible or desirable), it may be combined with the desired RGB color in Equation 4 to generate the $R_W G_W B_W W$ values for the display.

The various procedures outlined with the above examples may work with measured or modeled data from any RGBW display. It may also work with any other multi-primary display that has 4 primaries, such as an RGBC (red green blue and cyan) wide gamut display. There are, however, some special cases that can make the equations work out in ways that are easier, and thus less expensive, to manufacture in hardware. One simplification that is often made is to assume that the primaries of the display are exactly equal to the primaries from the source data, usually sRGB. When this is done, the combined RGBW to RGB matrix may exhibit zeros off the diagonal on the first three columns, like this example below:

$$\begin{pmatrix} 0.595188 & 0 & 0 & 0.377991 \\ 0 & 0.650871 & 0 & 0.382977 \\ 0 & 0 & 0.358207 & 0.423322 \end{pmatrix} \quad \text{Matrix 4}$$

If Matrix 4 is compared to Matrix 3, it may be seen that where Matrix 4 has a zero, Matrix 3 has a reasonably small number. This lends support to the idea that this may be a reasonable approximation for a well designed display. If Matrix 4 is used to perform the steps shown in Equations 1 through 5, the results are the following equations:

$$\begin{pmatrix} 1.680141R - 0.635078W \\ 1.536403G - 0.588407W \\ 2.791682B - 1.181780W \end{pmatrix} = \begin{pmatrix} R_W \\ G_W \\ B_W \end{pmatrix} \quad \text{Equation 6}$$

-continued $$\begin{pmatrix} 2.645566R \\ 2.611123G \\ 2.362269B \end{pmatrix} \geq \begin{pmatrix} W \\ W \\ W \end{pmatrix} \geq \begin{pmatrix} 2.645566R - 1.574610 \\ 2.611123G - 1.699504 \\ 2.362269B - 0.846181 \end{pmatrix} \quad \text{Equation 7}$$

Equation 7 shows one set of possible limits on the W value, and Equation 6 shows how to calculate Rw Gw and Bw given a desired RGB color and an arbitrarily chosen W value. It should be appreciated that the measured data for the previous example had a different white point than the input data and thus Equations 6 and 7 may do white point corrections as they convert from source colors to RGBW.

In yet another embodiment, there is another simplification that makes the hardware even less expensive to manufacture. If the display is assumed to have a white point identical to the source data, and the luminosities of the display primaries match the source, then the conversion becomes even simpler. This assumption is often reasonable if color fidelity may be relaxed as a feature of the display. This may be desirable in that the brightest color in the source data, RGB=(1,1,1), may map substantially to the brightest color in the RGBW display with RGBW=(1,1,1,1). When the measured values from the display are replaced with the standard chromaticity values, the RGBW to RGB matrix becomes:

$$\begin{pmatrix} 0.761840 & 0 & 0 & 0.238154 \\ 0 & 0.761846 & 0 & 0.238154 \\ 0 & 0 & 0.761846 & 0.238154 \end{pmatrix} \quad \text{Matrix 5}$$

It is noticed that this Matrix 5 has only two different coefficients in it. It should also be noticed that these coefficients may be reduced to only one coefficient by observing that the two coefficients sum to one. Thus 0.238154 can be replaced with (1−0.761846). When Matrix 5 is used to perform the steps shown in Equations 1 through 5, the results are the following equations:

$$\begin{pmatrix} 1.312601R - 0.312600W \\ 1.312601G - 0.312600W \\ 1.312601B - 0.312600W \end{pmatrix} = \begin{pmatrix} R_W \\ G_W \\ b_W \end{pmatrix} \quad \text{Equation 8}$$

$$4.198980 \begin{pmatrix} R \\ G \\ B \end{pmatrix} \geq W \geq \begin{pmatrix} 4.198980R - 3.198976 \\ 4.198980G - 3.198976 \\ 4.198980B - 3.198976 \end{pmatrix} \quad \text{Equation 9}$$

In yet another embodiment, an additional optimization may be achieved in that the maximum and minimum of R G and B may be taken before the other calculations. This may be desirable as this will reduce the number of multiplies from 6 to only 2.

Figure 7:
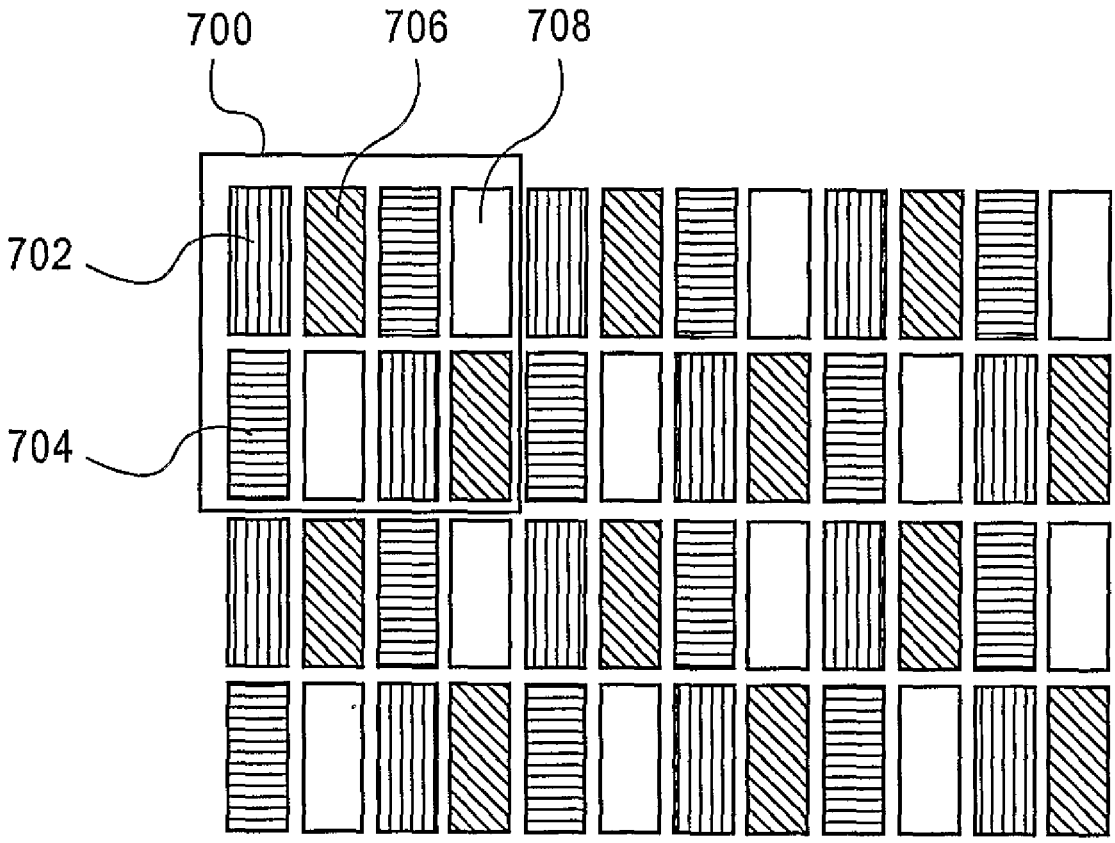
FIG. 7 is one exemplary subpixel layout for an embodiment of an RGBW display system.

For merely one example of a display system, FIG. 7 shows one possible subpixel layout for a display used in a display system. This layout comprises a repeating group of subpixels 700 with red 702 and blue 704 on a checkerboard and green 706 and white (or possibly some other color, like yellow) 708 on a second checkerboard. With this layout, there is an additional optimization that is possible. In this layout the luminance of the W sub-pixels is approximately equal to the luminance of all the color sub-pixels put together. In this case the RGBW to RGB matrix that results is particularly well suited for low-cost implementations. When the luminosity of W is assumed to be substantially equal to the sum of the other primaries (e.g. white or grey or wideband yellow), then Matrix 6 may be approximately as follows:

$$\begin{pmatrix} 0.5 & 0 & 0 & 0.5 \\ 0 & 0.5 & 0 & 0.5 \\ 0 & 0 & 0.5 & 0.5 \end{pmatrix} \quad \text{Matrix 6}$$

In this case, all the coefficients may be equated to 0.5 which are particularly convenient to implement in hardware. Of course, not all layouts may have results this simple, so Matrix 5 will be used as the example for most of the following discussion.

A typical assumption in some above embodiments is that both the RGBW and RGB color-spaces are mapped to a unit cube (or hypercube in the case of RGBW). This normalizing of the two color-spaces may not be absolutely correct, since the RGBW space can display brighter colors than the RGB. However, normalizing the spaces like this is a type of automatic gamut conversion, mapping the brightest RGB colors to the brightest RGBW colors. This gamut expansion may result in a brighter image. For each input color, the following procedure is followed:

(1) The input RGB color may be assumed to map to a larger output space and may be used as the desired output color.

(2) A W value is selected by arbitrarily starting from the luminance of the input color (for example) and then clamping it to the limits of Equation 9 (for example).

(3) Given the desired RGB values and the selected W value, the $R_W G_W B_W$ values are calculated using Equation 8 (for example).

Gamut clamping, which is described below, may also be required.

Figure 2:
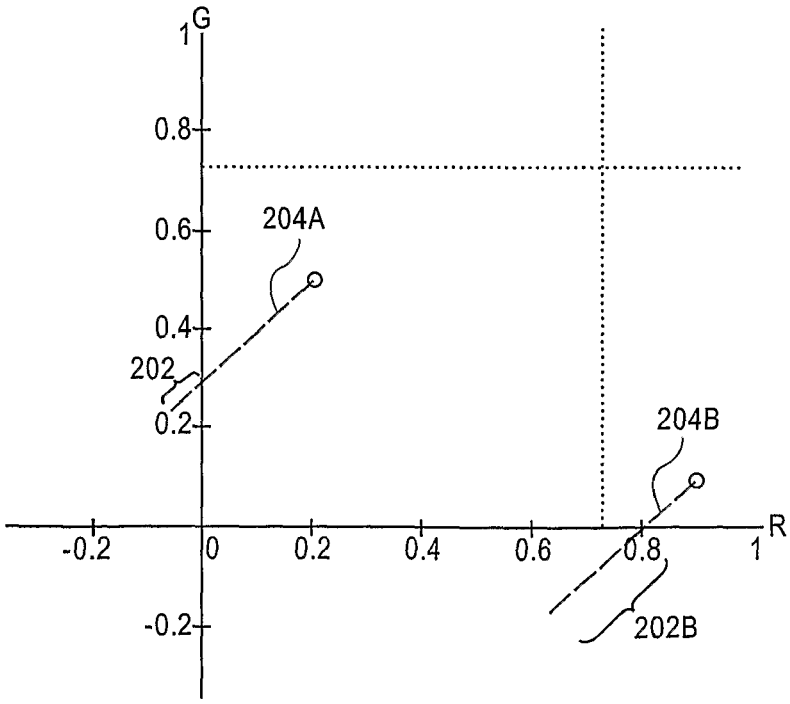
FIG. 2 shows two additional cases where the choice of W in an RGBW system may result in negative RGB values.

The following discussion of FIGS. 1 and 2 supplies a graphical intuition which may help communicate an understanding of the meaning of the above equations. Given a desired RGB color, it is possible to perform Equation 6 calculations for all possible W values between 0 and 1 and plot the resulting $R_w G_w B_w$ values. For a single RGB color, this may describe roughly a diagonal line in output RGB space. FIG. 1 is a plot of the resulting diagonal lines for three different RGB colors.

Because this is a plot of a slice from input RGB space, an adjustment may be made to plot RGBW values on it. The $R_w G_w B_w$ values may be scaled so that they indicate their maximum range of effect in RGB space. In this graph, it may not be desirable that scaled $R_w$ and $G_w$ values are outside the dotted square 106. The length of the diagonal lines indicates the maximum effect of W in the output RGB. The circles at the upper ends of the diagonal lines 102A, 102B and 102C indicate a possibly desired color. As W ranges from 0 (the upper right end of each line) to 1 (the lower left end) the line carves out $R_w$ and $G_w$ values that result from Equation 6.

Looking at the diagonal line 104A in FIG. 1, it is apparent that some of the points on the line that allow some of the $R_w$ and $G_w$ points to lie outside the dotted lines. The minimum projected length of W in the RGBW space may be long enough to prevent $R_w$ and $G_w$ values from getting too large. The right side of Equation 7 may provide that this may not happen. Looking at the diagonal line 104B in FIG. 1, it is apparent that W may be as long as possible to "reach" the desired color. The diagonal line 104C would allow W to have any value between 0 and 1 and still produce valid RwGwBw values in Equation 6.

FIG. 2 shows two more examples of possible W values for given output RGB values. Looking at the diagonal line 204A, some values of W result in negative RwGwBw values as in the left section 202 of the line 204A. The left side of Equation 7 tends to prevent this.

It should be noted that there are cases where all possible values of W may result in out-of-range values of $R_w G_w B_w$. The rightmost diagonal line 204B in FIG. 2 shows one example of this. In this case, it may be desirable to limit W to just the left side of Equation 7. This tends to prevent RwGwBw values from going negative as in the bottom section 202B of line 204B. They may still go positive out-of-bounds and this may be corrected by gamut clamping (as described below).

These RGB, $R_w G_w B_w$ and W values supplied or calculated in the above discussion may take on the range 0-1 but in an another embodiment, it may be desirable to have this replaced by an integer range, typically from 0 to 255. In hardware, a number of simplifying calculations may be made. For example, a division by 0.238154 can be replaced by a multiplication by 1/0.238154 or 4.198964. Also in hardware, this multiplication could be approximated by the integer operation of multiplying by 1074/256 or multiplying by 1074 and dropping the lower 8 bits of the result. The division by 0.761846 can be replaced by multiplying by 1/0.761846 or approximately 1.312601. In a hardware version this multiply can be further approximated by multiplying by 336 and dropping the lower 8 bits of the result. After a conversion to integer arithmetic and with an appropriate choice from Equations 5, it is possible to convert RGB to RGBW in as few as 4 multiplies, plus various operations like addition, comparing and shifting that are computationally much less expensive than multiplication. This will make implementation in hardware less expensive than other techniques while still producing correct colors.

As noted, there is a small class of colors that result in out-of-range $R_w G_w B_w$ values when converted from RGB to RGBW. Diagonal line 204*b* in FIG. 2 shows an example of this. The circle at the upper right of this line is the desired color in RGB space. The diagonal line shows all the possible $R_w G_w B_w$ values that may produce that color. Some of them have negative $G_w$ values and should not be used, and the rest have $R_w$ values that map to positions greater than the limit (e.g. at 0.761846). As mentioned above, a choice may be made in Equations 3 and 4 to limit the MinWP and MaxWP values so that the $R_w G_w B_w$ values are zero or positive. In the case of diagonal line 204*b*, the result may be an $R_w$ value that is too large. In other areas of the color-space, the other primaries—or pairs of them—may go out of range and become too large. The result may be out-of-gamut colors and these must be brought back into gamut in a way that does not produce visible defects in the image.

Several embodiments of methods and systems that bring colors back into gamut have been discussed in many above incorporated applications. One embodiment involves "gamut clamping"—where colors that lie outside the gamut are scaled until the color lies on the edge of the gamut. This may be accomplished by scaling all the primary values of a color by the same amount so that the hue of a color may not change as it is brought back into gamut. Another embodiment involves "gamut scaling". In this embodiment, colors going to the display are scaled so extra multipliers may be employed in a hardware version. Because many of the colors lie in volumes where the range of both color-spaces may have approximately the same range, gamut scaling may result in scaling the primary values by approximately 1, which has little or no effect. Mainly in colors, like the line 204*b* in FIG. 2, will the gamut scaling algorithm scale the colors down. As the colors approach the in-gamut areas from the outside, the scaling factor may approach 1, so there will be no sudden change in colors at the border.

LOW COST EMBODIMENTS

The following detail some low cost embodiments that implement the novel techniques described above and herein.

In one embodiment, the numbers may not need to be based on measurements of the chromaticity and luminosity values of a given display as manufactured. With these values, the brightest white on input (255,255,255) would be correctly color converted to the desired white-point output, which may not result in the brightest color (255,255,255,255) on output. One embodiment may take as given that the primaries are close to sRGB and their white-point is close to D65. Colors may not be absolutely correct but may be approximately correct and "bright" may map to "bright". One possible advantage may be that it decreases the total number of multipliers in the hardware design. Additionally, the numbers may not have to change if this design is used on different displays with different primary chromaticities.

Figure 3:
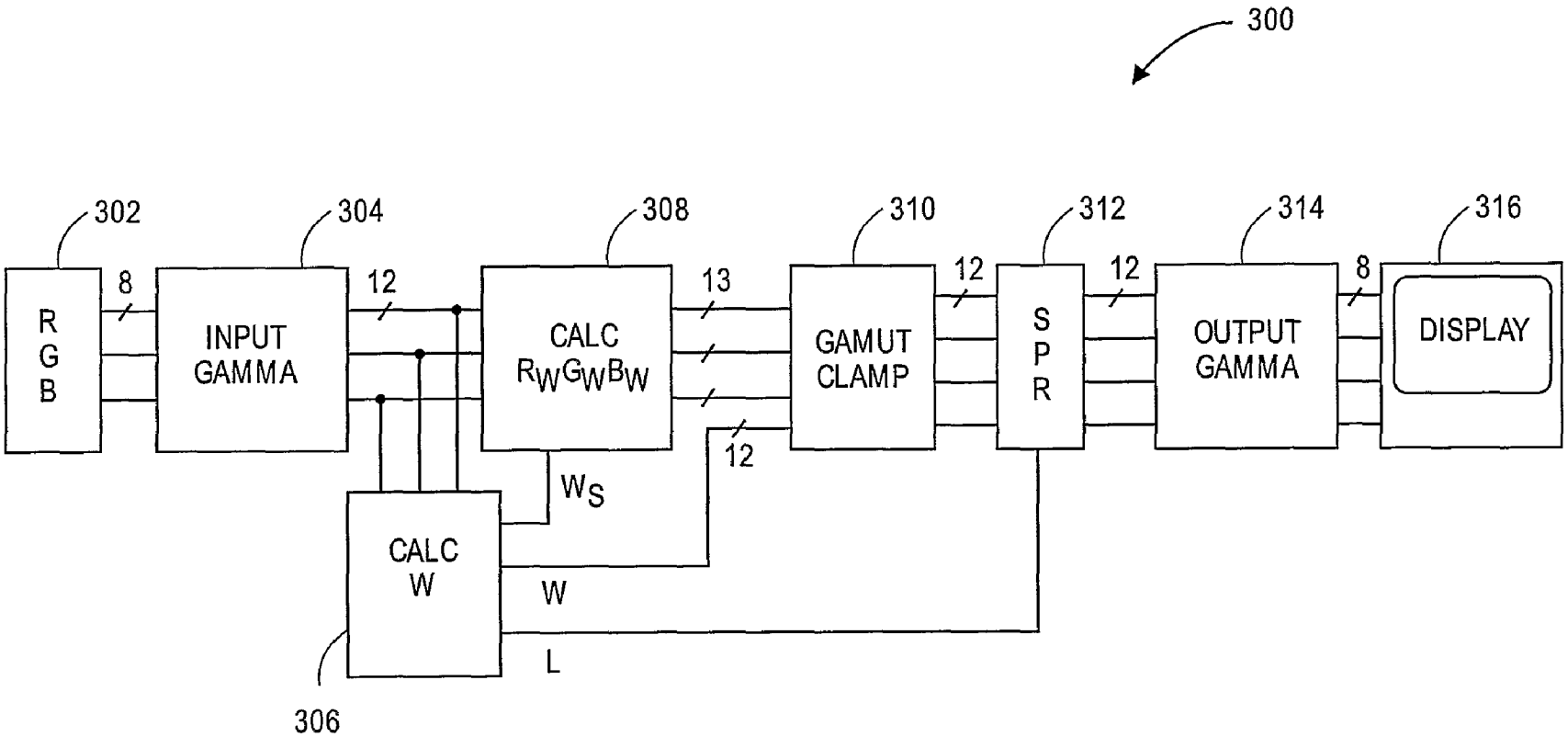
FIG. 3 shows a block diagram of a display system embodiment that is suitable for implementing the disclosed methods and techniques.

FIG. 3 shows an high level block diagram 300 of embodiment of a RGB to RGBW converter. For the sake of example, input 302 may take 8 bits each for R, G, and B for input, 12 bits for the linear data after gamma processing 304, and 8 bits output to the display 316. Of course, other systems may employ other numbers. Additionally, since this may not be the final configuration, the original floating point source values may be included for all the constants so they can be converted for different bit depths. Additionally, it will be appreciated that the present invention is applicable in general to systems that take in three color primary image data and convert to four color primary image data. For example, such a system could accept as input: RGB stripe data, YCbCr, data, sRGB data, and YUV data and any other suitable three color data. Such a system could output a plurality of four color data, including, but not limited to: RGBW, RGBY, RGBC, RGBM, RGCM or the like.

Input Gamma LUT 304

One embodiment of input gamma 304 would be to use an sRGB input gamma curve. Most files on PC computers are built with this gamma assumption, and most images on cellphones may employ this assumption. However, it is possible to reduce gamma pipeline errors by building the input gamma curve from the output, or building both together from the same source data. Thus, other embodiments may change the exact input gamma LUT used, based on the final display configuration.

Luminance Based W Calculation 306

Block 306 for calculating the W value may take on several embodiments—based the set of following Equations 10:

$$(1)\ L=(2*R+5*G+B)/8$$

$$(2)\ W_S=L*M1$$

$$(3)\ W_S=\max(W_S,(\max(R,G,B)-M0))$$

$$(4)\ W_S=\max(W_S,0)$$

$$(5)\ W_S=\min(W_S,\min(R,G,B))$$

$$(6)\ W=W_S/M1$$

Equations 10

Line 1 above calculates Luminosity (L) using an approximation that can be done in hardware with shifts and adds. This L value is used here and also saved for later use in the Sub-Pixel-Rendering (SPR) module. Of course, other equations approximating L could be used—some involving more computation.

Line 2 sets $W_S$ (W scaled) to a value it would have if based entirely on luminance where $M_1$ may be a constant, approximately equal to 0.503384. This may be approximated by dividing by two—but may also be accomplished by multiplying by 129 and right shifting the result 8 times. In some instances, the $W_S$ value may be out of range and may be processed accordingly, including being clamped in the following lines. $W_S$ may be employed as an intermediate value that may be saved to reduce multiplies when calculating $R_WG_WB_W$ in later steps.

Line 3 clamps the $W_S$ value to a minimum value it is allowed to have and still keep the final $R_W$, $G_W$, and $B_W$ values in range. The minimum $W_S$ value approximates the maximum of the RGB input values after subtracting a value, $M_0$. In one embodiment, $M_0$ may be a constant (approximately equal to 0.496616) and may additionally be scaled to the range of the gamut pipeline. In the case of an embodiment employing a 12 bit pipeline, $M_0$ may be multiplied by $2^{12}-1$ or 4095 and the value subtracted would be 2034 (rounded up for safety). Of course, it is to be appreciated that other values for the various constants would be used according to the particular design of the system (e.g. 12 bits versus some other bit value for the pipeline—other system parameters may also effect the choice of values). It should also be noted that this formula might vary if the system is concerned with color fidelity and not converting bright colors to bright colors. For convenience, Table 1 depicts different embodiments with the decimal value calculated for different bit sizes of the gamma pipeline.

TABLE 1

Values of $M_0$ for Gamma Pipeline Bit Values

| | Bits | | | | | | | | |
|---|---|---|---|---|---|---|---|---|---|
| | 8 | 9 | 10 | 11 | 12 | 13 | 14 | 15 | 16 |
| $M_0$ | 127 | 254 | 509 | 1017 | 2034 | 4068 | 8137 | 16273 | 32546 |

Line 4 tends to prevent $W_S$ from going negative when the input RGB values are out of gamut in the RGBW system. If the result would go negative, the value zero may be substituted instead.

Line 5 tends to limit the $W_S$ value to a maximum allowed and still keep the $R_WG_WB_W$ values in range. It also tends to prevent negative values when the source RGB value is outside the RGBW gamut. Positive out-of-gamut values may be easier to detect and clamp.

Figure 4:
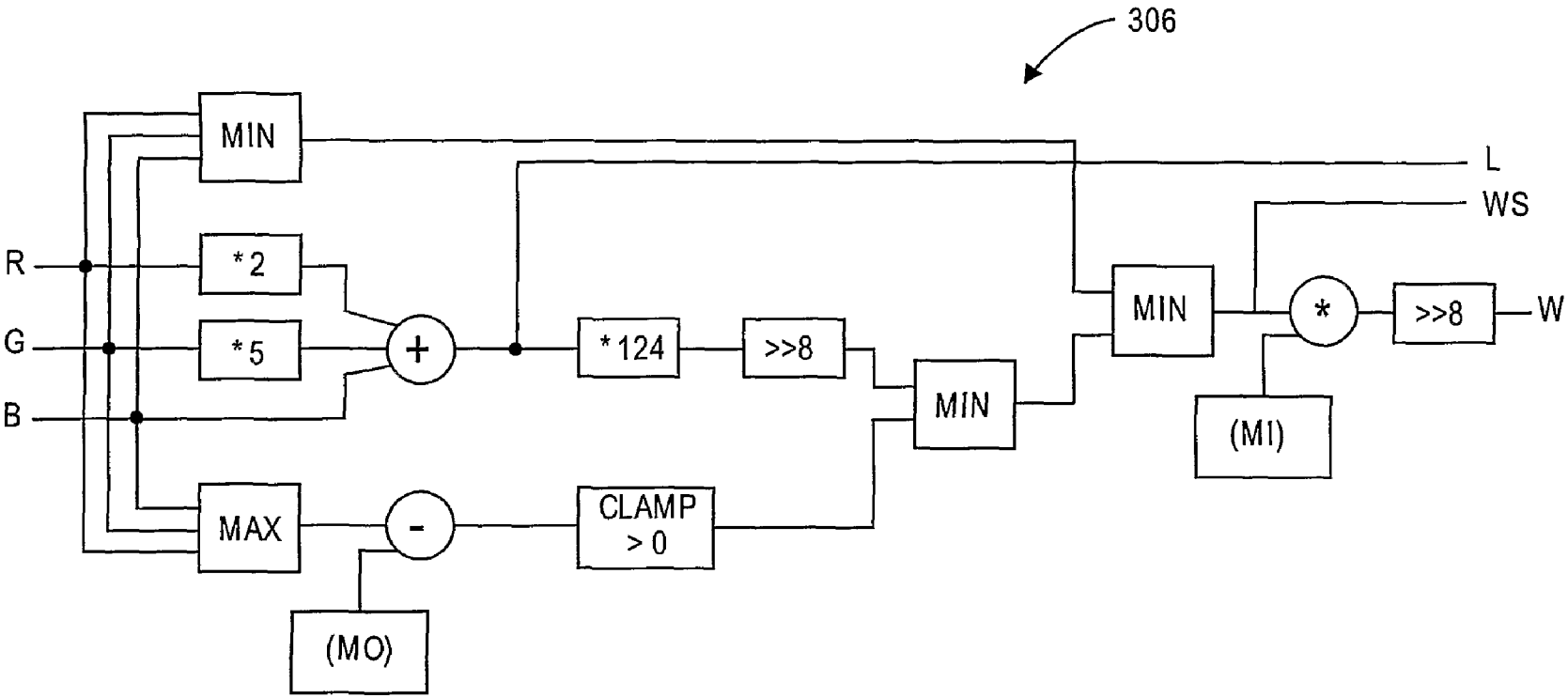
FIG. 4 shows one embodiment of the CALC W module of FIG. 3.

Finally, line 6 of Equations 10 calculates a final W value. $M_1$ is employed and which approximately equals 0.503384. This can alternatively be accomplished by multiplying by $1/M_1$ which would be 1.986555. Although this is almost multiplying by two, it could be better approximated by multiplying $1/M_1$ by 256, (rounding down for safety in this case) resulting in 508. Now $W_S$ can be multiplied by 508 and then right shifted 8 bits to accomplish the divide by $M_1$. FIG. 4 is a high level block diagram of one embodiment of block 306. It will again be appreciated that other values may be employed, depending upon the design constraints and considerations of the system. It will be appreciated that the numeric values for multiply and shift (e.g. 124 and 8 respectively) in FIG. 4 may vary according to the particular values of M0 and M1.

Calculate RwGwBw 308

One embodiment of a set of formulae for calculating the $R_W G_W B_W$ value is seen in Equations 11:

$$R_W=(R-M_1*W)/M_0$$

$$G_W=(G-M_1*W)/M_0$$

$$B_W=(B-M_1*W)/M_0 \qquad \text{Equations 11}$$

Figure 5:
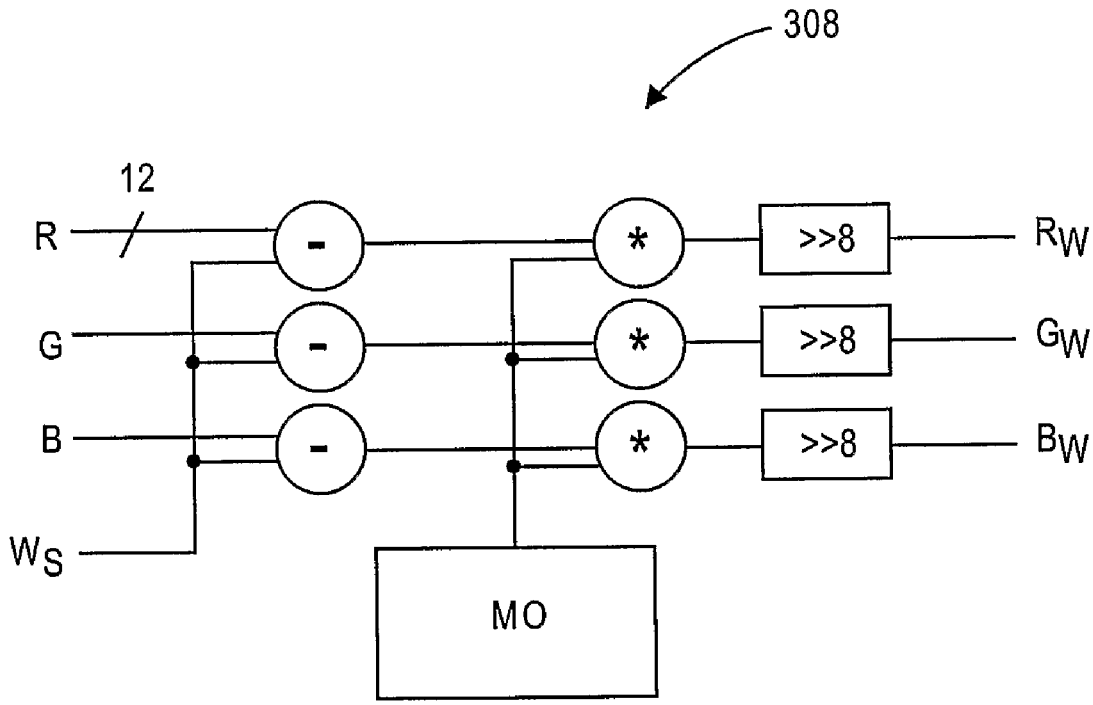
FIG. 5 shows one embodiment of the CALCULATE $R_WG_WB_W$ module of FIG. 3.

However, $M_1*W$ is the intermediate value $W_S$ that may be saved from the previous step (and as seen in embodiment in FIG. 4), so the extra multiplies may not be required here. Dividing by $M_0$ is substantially the same as multiplying by 2.013628. This is almost multiplying by two, and to retain more accuracy, it may be performed by multiplying by 515 and right shifting 8 times. However, doing this may result in an overflow of more than one bit(s) as discussed below and the multiplier may be to be lowered from 515 to prevent this. The value of 512 is one possible value (and possibly one of the largest values) that may not result in a two-bit-overflow. This is similar to multiplying by 2 (or left shifting) once. This optimization may work with both a 10 bit and a 12 bit internal gamma pipeline. With other pipeline sizes, the multiplier may need to be re-calculated FIG. 5 depicts merely one possible embodiment of the above processing—other implementations with other values as intimated above are, of course, suitable for purposes of the present invention.

These multiplies are expected to often overflow by one bit. In the case of a 12 bit gamma pipeline this means that the result must be allowed to be 13 bits large. This extra bit cannot be discarded or clamped, as out-of-gamut colors are allowed. The 13th bit of precision must be preserved in this multiply for the gamut clamping in the next step.

Gamut Clamping 310

Figure 6:
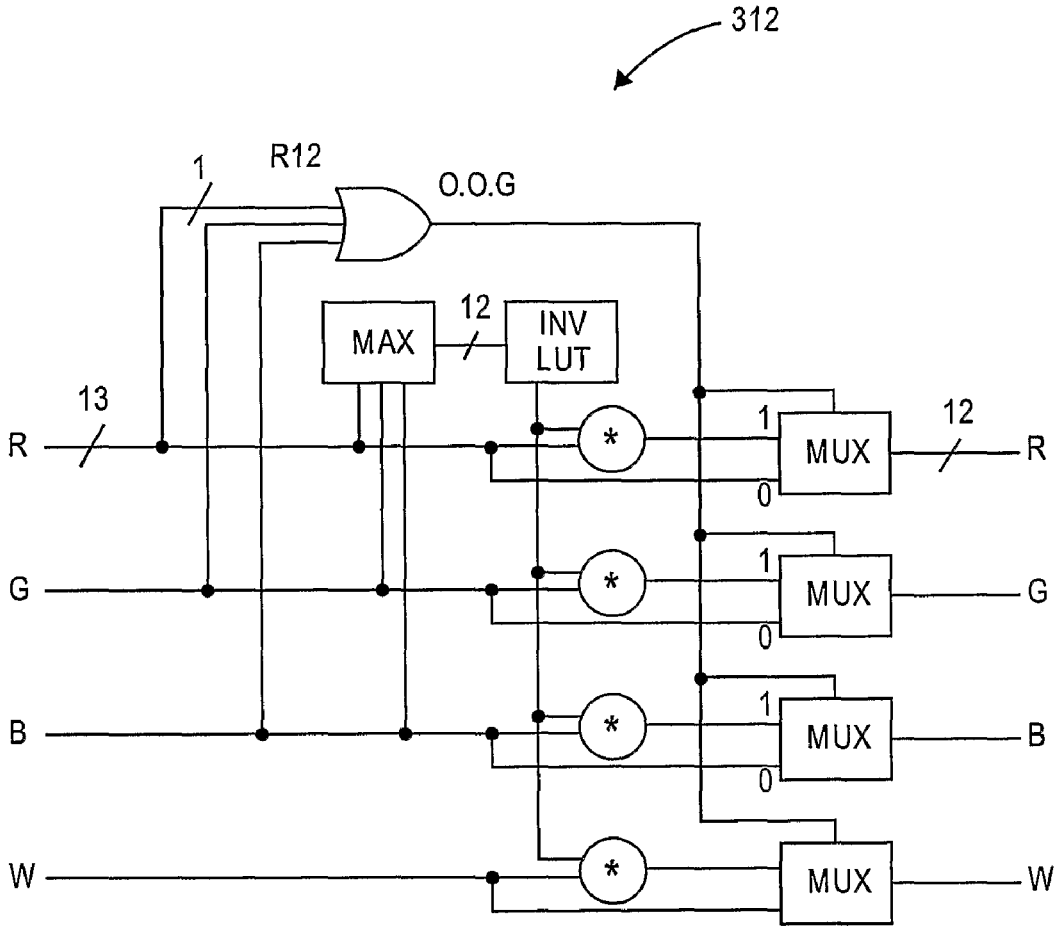
FIG. 6 shows one embodiment of the GAMUT CLAMP module of FIG. 3.

When black and white are mapped to the same or similar colors in RGB and RGBW, the total gamut "volume" of RGBW turns out to be slightly smaller than RGB of equal brightness. This means that there may be some colors, especially bright saturated colors, that exist in the expanded RGB but may not be displayed in RGBW. When these colors arrive, something reasonable may be done. Simply clamping the RGBW values to the maximum range may result in the hue of these colors being distorted. Instead, the out-of-gamut colors may be detected and scaled in a way that preserves hue while bringing them back into range. FIG. 6 depicts merely one possible embodiment of the gamut clamping disclosed herein.

Detecting In-Gamut

The multipliers in the previous step may be designed to return values larger than their input values. This may allow out-of-gamut (O.O.G.) values to be calculated. These values may not be more than twice the range of the input values, so one more bit in the output may allow values to "overflow". If this extra overflow bit is zero in all three of the R G and B results, then the color is in gamut and it could be gated around the rest of the gamut clamping path. FIG. 6 shows the upper bit (bit 12) of all three converted primaries OR'ed together to produce the O.O.G. signal.

Out-Of-Gamut Response

If the overflow bit in any one of the R, G, and B results is ON, this indicates that an out-of-gamut color may have resulted and all four of the primaries may be scaled by a substantially same factor. Scaling all four components by a substantially same factor decreases luminosity but preserves hue. This scale factor may be a number slightly less than one, so it may be a fixed point binary fraction.

Maximum Component

The ratio of distance to the edge of the gamut relative to the out-of-gamut distance is one suitable calculation of the gamut scaling factor to bring out-of-gamut values back in range. Unfortunately, this may require calculating two square roots. Fortunately, the ratio of the width of the color-space relative to the maximum component of the out-of-gamut color gives a suitable result as well. The width of the color-space is a power of two ($2^{12}$ for the case of 12 bit linear RGB values) and becomes a bit shift. Thus, the maximum component of the out-of-gamut color is easy to select. The result of the maximum comparison while calculating W may be saved and used at this point to avoid extra gates here.

Inverse LUT

The maximum out-of-gamut component may be inverted by looking it up in an inverse LUT. Occasionally, values do approach $2^{13}$, so a table of the upper half of an inverse curve may be desirable as one possible embodiment. The table could be designed to accept the lower 12 bits of the out-of-gamut number and return an 8 bit fixed-point binary number. The formula for this LUT is for x=0 to 4095, INV(x)=floor ((256*4096)/(x+4096+1)). An inverse table may introduce errors, but the upper half of the 1/x table is not where the errors typically occur, so this may safely be done here.

Clamping Multipliers

The Inverse LUT can be calculated to have 8 bit values in it, so three 13×8=12 multipliers will be necessary to scale out-of-gamut values back down into range. The actual function done by the multipliers is (A*B)/256 where A is the 13 bit out-of-gamut value and B is the inverse number from the LUT. The output of the multipliers need only be 12 bits because the inverse numbers are all fixed point binary numbers between 0.5 and 1. Storing these inverse values as 8 bit numbers results in clamped values that are slightly less than the expected number. However, the error is always smaller than 1% and it is always too small, guaranteeing that the clamped numbers are back in range to fit in a 12 bit result.

When the color is out of gamut then all the R, G, B, and W components are multiplied by the output of the Inverse LUT. It should be noted that the W value is typically not out of gamut and does not need to be stored as 13 bits or tested for out-of gamut. When the color is in gamut, the lower 12 bits of the input values are gated around the multipliers, bypassing the gamut clamping as shown in FIG. 6.

SubPixel Rendering 312

The SPR module 312 could be any known subpixel rendering algorithm—including several that are disclosed in many of the above incorporated applications. In this application, the output from multi-primary conversion is in linear color components so the sub-pixel rendering module may not have to perform input gamma conversion. This also means that the input components will have more than 8 bits per primary, 12 bits in this case. In the architectural diagram, the output gamma being performed after the subpixel rendering allows the data to stay in the linear domain until the last moment before being converted to send to the display.

Output Gamma LUT 314

One possible embodiment for handling output gamma 314 would be to measure the gamma curves of the Red Green and Blue sub-pixels directly. These would be used to create inverse gamma curves to compensate for the non-linear response of the display. Because an sRGB input gamma curve is used on the input, the net effect of the gamma pipeline is to apply only an sRGB curve to all data. So the exact output gamma LUT used may change based on the final display configuration.

While the techniques and implementations have been described with reference to exemplary embodiments, it will be understood by those skilled in the art that various changes may be made and equivalents may be substituted for elements thereof without departing from the scope of the appended claims. In addition, many modifications may be made to adapt a particular situation or material to the teachings without departing from the essential scope thereof. Therefore, the particular embodiments, implementations and techniques disclosed herein, some of which indicate the best mode contemplated for carrying out these embodiments, implementations and techniques, are not intended to limit the scope of the appended claims.

What is claimed is:

1. A non-transitory computer-readable medium storing instructions that are executed and converting input image data specified in three input primary colors into an image data set of four display primary colors, the converting input image data comprising:

determining a value of a first display primary color of said set of four display primary colors; and determining values of second, third and fourth display primary colors and for computing a solution set to simultaneous equations based upon the value of the first display primary color, wherein the determining a value of a first display primary color includes determining a maximum value and a minimum value for the first display primary color and producing the value of the first display primary color according to a linear combination of the maximum and minimum values.

2. The non-transitory computer-readable medium of claim 1 wherein the input image data specified in three input primary colors is one of a group, said group comprising: RGB stripe data, YCbCr, data, sRGB data, and YUV data.

3. The non-transitory computer-readable medium of claim 1 wherein the four display primary colors of the image data set is one of a group, said group comprising: RGBW, RGBY, RGBC, RGBM, RGCM.

4. The non-transitory computer-readable medium of claim 1 wherein the non-transitory computer-readable medium comprises instructions for determining a set of permissible values for the first display primary color.

5. The non-transitory computer-readable medium of claim 1 wherein the non-transitory computer-readable medium comprises instructions for averaging the maximum and minimum values to produce the value of the first display primary color.

6. A computer-readable non-transitory medium storing instructions that are executed and converting input image data specified in three input primary colors into an image data set for rendering on a display, the converting input image data comprising:

calculating a value for a first image data based upon the input image data;

deriving an allowable value for the first image data based upon a chromaticity specification for the display; and calculating output values for second, third and fourth image data based upon the allowable value for the first image data, wherein the calculating of the value for the first image data includes determining a maximum value and a minimum value for the first image data and producing the value for the first image data according to a linear combination of the maximum and minimum values.

7. The computer-readable non-transitory medium of claim 6 wherein the calculating the value for the first image data uses luminance values of the second, third and fourth image data.

8. The computer-readable non-transitory medium of claim 6 wherein the chromaticity specification of said display is measured from said display.

9. The computer-readable non-transitory medium of claim 6 wherein the chromaticity specification of said display is derived from the display.

* * * * *